US005143461A

United States Patent [19]

Inoue et al.

[11] Patent Number: 5,143,461

[45] Date of Patent: Sep. 1, 1992

[54] PRINTER

[75] Inventors: Teruhisa Inoue, Shizuoka; Toshiharu Shimosato, Shizuoka, both of Japan

[73] Assignee: Tokyo Electric Co., Ltd., Tokyo, Japan

[21] Appl. No.: 552,020

[22] Filed: Jul. 13, 1990

[30] Foreign Application Priority Data

Jul. 14, 1989 [JP] Japan ..... 1-182186

[51] Int. Cl.[5] ..... B41J 33/16

[52] U.S. Cl. ..... 400/225; 400/223; 400/234; 400/236

[58] Field of Search ..... 400/208, 223, 225, 230, 400/231, 234, 235, 236, 236.2, 120, 240, 621, 622, 623, 5.78, 601, 607, 218, 614, 614.1, 618

[56] References Cited

U.S. PATENT DOCUMENTS 4,577,199 3/1986 Saiki et al. ..... 346/76 PH
4,675,698 6/1987 Tsutsumi ..... 346/76 PH
4,812,063 3/1989 Kunimitsu et al. ..... 400/234

FOREIGN PATENT DOCUMENTS 194880 11/1984 Japan ..... 400/234
125875 6/1986 Japan ..... 400/234
241178 10/1986 Japan ..... 400/225
62-56178 3/1987 Japan .
82061 4/1987 Japan ..... 400/234

*Primary Examiner*—Edgar S. Burr
*Assistant Examiner*—Joseph R. Keating
*Attorney, Agent, or Firm*—Oblon, Spivak, McClelland, Maier & Neustadt

[57] ABSTRACT

A thermal head of a printer is provided to contact a platen through an elongated print paper and an elongated ink ribbon. One end of the ink ribbon is wound and retained on a ribbon core, and the other end is taken up by a take up spool. The print paper and the ink ribbon can be fed back at the same speed by reversely rotating the platen. At the same time, rotation resistance to be applied from the take-up spool to the ink ribbon is removed by a resistance removing device. Further, the ribbon core is reversely rotated by a ribbon core reverse driving device to rewind the ink ribbon, thereby preventing slacking of the ink ribbon.

6 Claims, 3 Drawing Sheets

PRINTER

FIELD OF THE INVENTION AND RELATED ART STATEMENT

The present invention relates to a printer for printing an elongated print paper by transferring ink of an ink ribbon onto the print paper by a thermal head, sequentially cutting the print paper after printed, and issuing printed sheets of paper such as labels and tags. More particularly, the present invention relates to a structure for feeding the ink ribbon.

Conventionally, there exists a printer such that an elongated ink ribbon and an elongated print paper are sandwiched between a platen and a thermal head to print the print paper, and a printed part of the print paper is then cut to be issued as a label or the like. In such a printer, a plurality of heat generating elements of the thermal head are selectively heated, and the ink of the ink ribbon is transferred onto the print paper by the heat of the heat generating elements. At this time, the platen is rotated to feed the print paper and the ink ribbon at the same speed and thereby move the print paper relative to the thermal head, thus effecting desired printing on the print paper. Then, the print paper after printed is drawn from the thermal head to a cutter, and is cut by the cutter for issuance as a label or the like.

As the cutter is located at a given distance from the thermal head, a non-printed part of the printed paper having a length corresponding to the above distance is unduly generated. To eliminate the generation of such an undue non-printed part, the print paper is fed back to the platen side by the distance between the thermal head and the cutter after the cutting operation.

However, if the print paper only is fed back, it slips on the ink ribbon to generate stain. To solve this problem, the thermal head is separated from the platen before feeding back the print paper to thereby separate the ink ribbon, and thereafter the print paper is fed back. However, according to this conventional technique, the structure is complicated, and the overall apparatus is enlarged in size. Particularly, in the case of manually separating the thermal head from the platen, such a manual operation is troublesome.

In another conventional technique such that both the ink ribbon and the print paper are fed back, there occurs slacking of the ink ribbon during back feeding, which causes the generation of wrinkle of the ink ribbon in a subsequent printing operation, with the result that the printing operation cannot be properly carried out.

OBJECT AND SUMMARY OF THE INVENTION

It is a first object of the present invention to provide a printer which can feed back the elongated print paper without separating the thermal head from the platen to thereby prevent the generation of stain on the print paper.

It is a second object of the present invention to provide a printer which can feed back the ink ribbon upon back feeding of the print paper and prevent the generation of wrinkle of the ink ribbon.

According to the present invention, there is provided a printer comprising a reversible platen for feeding an elongated print paper to be guided along a predetermined traveling path from a paper supply portion to a paper discharge portion; a thermal head contacting said platen with an elongated ink ribbon and said print paper sandwiched therebetween for carrying out printing on said print paper; a reversible ribbon core for winding and retaining said ink ribbon; a reversible take-up spool for taking up said ink ribbon drawn from said ribbon core and guided to between said platen and said thermal head; platen reverse driving means for reversely rotating said platen and feeding back said print paper and said ink ribbon at the same speed; resistance removing means for removing resistance to be applied from said take-up spool to said ink ribbon upon reverse rotation of said platen; and ribbon core reverse driving means for reversely rotating said ribbon core to let said ribbon core rewind said ink ribbon upon reverse rotation of said platen.

With this arrangement, when the platen is reversely rotated by the platen reverse driving means under the condition where the platen is in contact with the thermal head through the print paper and the ink ribbon, the print paper and the ink ribbon are fed back at the same speed. At this time, the rotation resistance to be applied from the take-up spool to the ink ribbon is removed by the resistance removing means. Accordingly, there occurs no difference in back feeding speed between the print paper and the ink ribbon at the position of the platen. That is, there occurs no slippage between the print paper and the ink ribbon to thereby prevent the generation of stain on the print paper due to the ink ribbon. Furthermore, upon back feeding of the ink ribbon, the ribbon core is reversely rotated by the ribbon core reverse driving means to rewind the ink ribbon. Accordingly, there occurs no slack of the ink ribbon between the platen and the ribbon core, and it is possible to prevent wrinkling of the ink ribbon in carrying out a subsequent printing operation.

Other objects and features of the invention will be more fully understood from the following detailed description and appended claims when taken with the accompanying drawings.

DESCRIPTION OF PREFERRED EMBODIMENT

Figure 1:
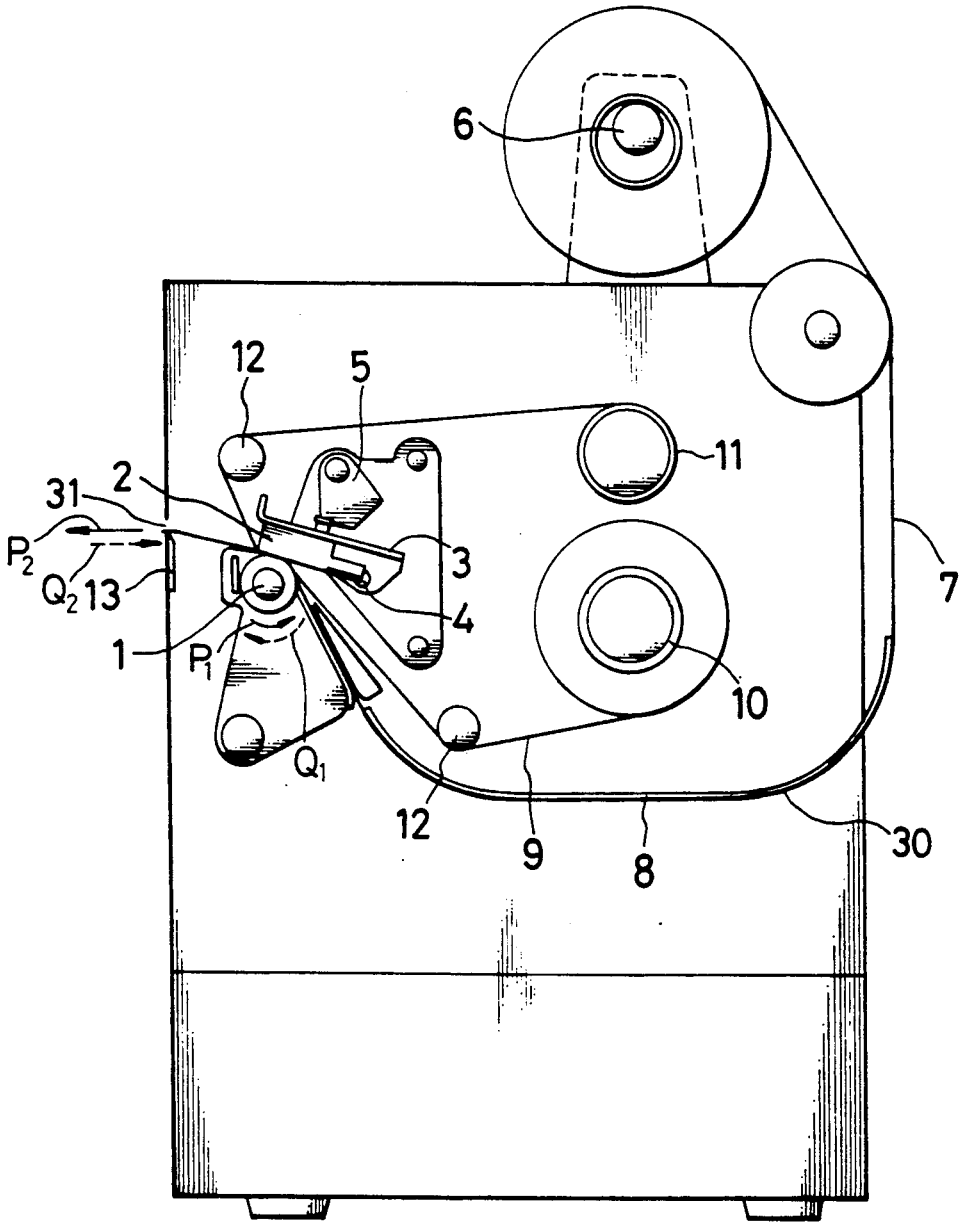
FIG. 1 is a sectional side view of a general construction of the printer according to the present invention.

A preferred embodiment of the present invention will now be described with reference to FIGS. 1 to 5. Referring first to FIG. 1, a platen 1 is provided to be driven by a reversible step motor 50 which constitutes a platen reverse driving means according to the present invention. A thermal head 2 is so provided as to face the platen 1. The thermal head 2 is retained by a head frame 3. The head frame 3 is pivotably supported to a pivotal shaft 4. A cam 5 is pivotably supported to urge the head frame 3 toward the platen 1. An elongated print paper 7 is wound around a paper supply portion 6. A paper guide plate 8 is provided to guide the elongated print paper 7 to a gap between the platen 1 and the thermal head 2. Thus, a traveling path 30 of the elongated print paper 7 is formed along the paper guide plate 8 until a paper discharge portion 31 formed at a predetermined distance from the platen 1. The paper discharge portion 31 is provided with a cutter 13 for cutting the elongated print paper 7 after printed. On the other hand, an elongated ink ribbon 9 is wound around a cylindrical ribbon core 10, and is taken up by a take-up spool 11. In a traveling path of the elongated ink ribbon 9 between the ribbon core 10 and the take-up spool 11, there are provided two guide shafts 12 for guiding the elongated ink ribbon 9.

Figure 2:
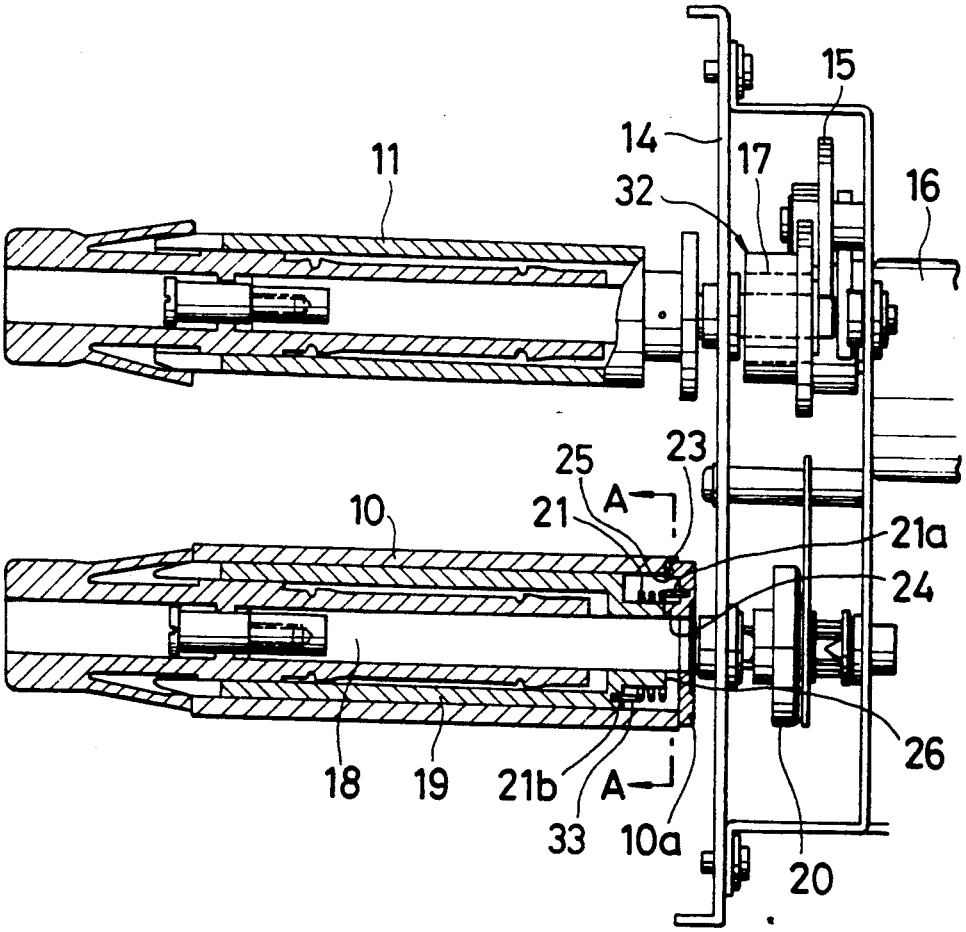
FIG. 2 is a vertical sectional elevation of the take-up spool, the ribbon core and the supply spool shown in FIG. 1.

Referring to FIG. 2, the take-up spool 11 is rotatably supported to a frame 14 in a cantilever manner. A power transmitting mechanism 15 having a plurality of gears is mounted to the frame 14. An input side of the power transmitting mechanism 15 is connected to a reversible DC motor 16 constituting a take-up spool driving means according to the present invention, while an output side of the power transmitting mechanism 15 is connected through a one-way clutch 17 to the take-up spool 11. The motor 16 and the one-way clutch 17 constitute a resistance removing means 32 according to the present invention.

Figure 3:
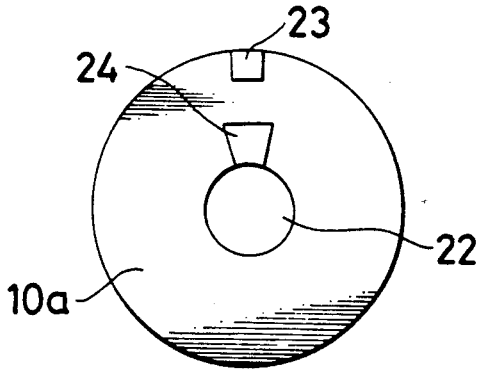
FIG. 3 is a side view of a ring of the ribbon core as viewed from the left side in FIG. 2.
Figure 4:
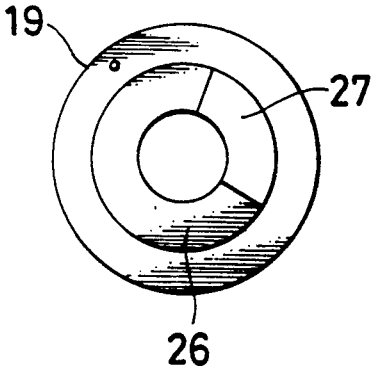
FIG. 4 is a side view of the supply spool as viewed from the right side in FIG. 2.
Figure 5:
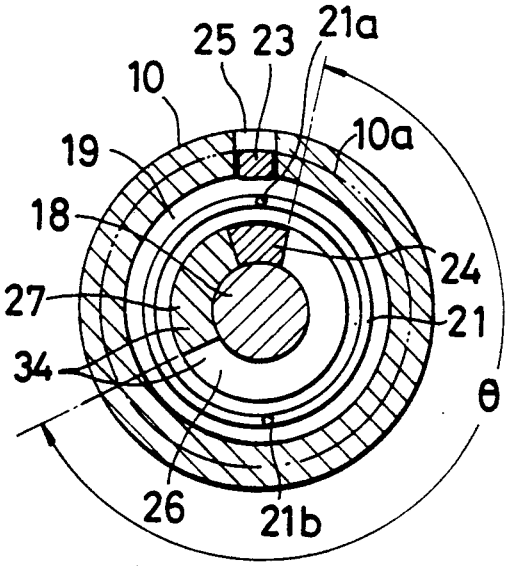
FIG. 5 is a cross section taken along the line A—A in FIG. 2.

Referring still to FIG. 2, a rod-like support shaft 18 is rotatably supported to the frame 14 under the take-up spool 11, and a cylindrical supply spool 19 is fixedly mounted on the support shaft 18 in coaxial relationship with each other. A back tension mechanism 20 for giving friction to free rotation of the supply spool 19 is connected to the support shaft 18 and mounted to the frame 14. The ribbon core 10 is mounted on the supply spool 19 in coaxial relationship with each other so that the former may be rotated relative to the latter within a given angular range $\theta$ (see FIG. 5). A ring 10*a* is mounted on one end of the ribbon core 10 so as to close the same. More specifically, as shown in FIG. 3, a projection 23 is formed on an inside surface of the ring 10*a* at an outer circumferential position thereof. The projection 23 of the ring 10*a* is closely fitted with a recess 25 formed on the end surface of the ribbon core 10. Further, a shaft insertion hole 22 is formed at a central portion of the ring 10*a* for inserting the support shaft 18. Another projection 24 is formed on the inside surface of the ring 10*a* at an inner circumferential position thereof. On the other hand, as shown in FIGS. 4 and 5, and end surface of the supply spool 19 facing the ring 10*a* is formed with a recess 26 and a projection 27 for permitting displacement of the projection 24 of the ring 10*a* within the angular range $\theta$. That is, the ring 10*a* is permitted to rotate independently of the supply spool 19 within the angular range $\theta$. However, after abutment of the projection 24 of the ring 10*a* with the projection 27 of the supply spool 19, the supply spool 19 and the ring 10*a* are rotated together. Thus, the projection 24, the recess 26 and the projection 27 constitute an independent rotation limiting means 34 according to the present invention. Further, as shown in FIG. 2, a torsion spring 21 is wound around an end portion of the supply spool 19 facing the ring 10*a*. The torsion spring 21 has one hook 21*a* fixedly engaged with the inside surface of the ring 10*a* and the other hook 21*b* fixedly engaged with the supply spool 19. Thus, the torsion spring 21 constitutes a ribbon core reverse driving means 33 according to the present invention.

In operation, when the platen 1 is forwardly driven in a direction as shown by a solid arrow $P_1$ in FIG. 1, the print paper 7 and the ink ribbon 9 contacting each other between the platen 1 and the thermal head 2 are fed forwardly in a direction as shown by a solid arrow $P_2$ in FIG. 1. At this time, the motor 16 is forwardly driven to forwardly rotate the take-up spool 11 through the power transmitting mechanism 15 and the one-way clutch 17. Accordingly, the ink ribbon 9 fed by the platen 1 is taken up by the take-up spool 11 by the same amount. Simultaneously, the ribbon core 10 is rotated together with the ring 10*a* forwardly (i.e., clockwise as viewed in FIG. 5) by the tension of the ink ribbon 9. When the rotational angle of the ribbon core 10 is within the angular range $\theta$, the ribbon core 10 and the ring 10*a* are rotated independently of the supply spool 19 which is maintained in a stop condition by a braking force of the back tension mechanism 20. During the forward rotation of the ribbon core 10 and the ring 10*a* within the angular range $\theta$, the torsion spring 21 is twisted in such a direction as to be shrunk. Thereafter, when the ink ribbon 9 is further fed forwardly (clockwise as viewed in FIG. 5) at an angle exceeding the angular range $\theta$, the projection 24 of the ring 10*a* abuts against the projection 27 of the supply spool 19, causing simultaneous rotation of the ring 10*a* and the supply spool 19 against the braking force of the back tension mechanism 20. The print paper 7 after printed and discharged from the paper discharge portion 31 is cut by the cutter 13 and issued.

As the cutter 13 is located at a distance from the thermal head 2, a blank or non-printed area of the print paper 7 after printed is generated according to this distance. To eliminate such an undue blank area of the print paper 7, the print paper 7 and the ink ribbon 9 are fed back in a direction as shown by a dashed arrow $Q_2$ in FIG. 1 by reversely rotating the platen 1 in a direction as shown by a dashed arrow $Q_1$. At this time, free rotation of the take-up spool 11 is allowed by the resistance removing means 32. That is, when the motor 16 is reversely rotated, the transmission of the rotation of the motor 16 through the power transmitting mechanism 15 is cut by the one-way clutch 17. As a result, the take-up spool 11 can be freely rotated without receiving the resistance from the motor 16 and the power transmitting mechanism 15. Accordingly, the print paper 7 and the ink ribbon 9 contacting each other between the platen 1 and the thermal head 2 are simultaneously fed back at the same speed without relative slippage. Therefore, stain of the print paper 7 due to slippage relative to the ink ribbon 9 may be prevented. Furthermore, as it is not necessary to separate the thermal head 2 from the platen 1, complication of the structure and enlargement of the overall apparatus may be avoided. In addition, the operation is easy.

During the reverse feed of the print paper 7 and the ink ribbon 9, the ribbon core 10 and the ring 10*a* are rotated counterclockwise as viewed in FIG. 5 by a torque (return force) of the torsion spring 21, thereby rewinding the ink ribbon 9. Accordingly, slacking of the ink ribbon 9 between the platen 1 and the ribbon core 10 may be eliminated to prevent wrinkling of the ink ribbon 9. Therefore, a subsequent printing operation may be properly carried out.

In modification of the above preferred embodiment, the resistance removing means may be constructed in such that the motor 16 is reversely driven in synchronism with reverse rotation of the platen 1 to positively reversely rotate the take-up spool 11. Alternatively, the resistance removing means may be constructed of an ordinary clutch such that when a reverse driving force is applied to the take-up spool 11, the connection between the take-up spool 11 and the motor 16 connected to the power transmitting mechanism 15 is cut. In this case, the motor 16 may be constructed of a normal motor permitted to rotate in a forward direction only.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A printer comprising:

paper supply means for supplying elongated print paper;

paper discharge means for discharging said print paper;

guide means for guiding said paper from said paper supply means to said paper discharge means;

reversible platen means for feeding said paper along said guide means from said paper supply means to said paper discharge means;

reversible ribbon core means for winding and retaining an elongated ink ribbon;

thermal head means for contacting said platen and printing on said print paper, wherein said ribbon and said print paper are sandwiched between said thermal head means and said platen means for carrying out said printing on said print paper;

reversible take-up spool means for taking up said ribbon drawn from said ribbon core means and guided through said guide means between said platen means and said thermal head means;

platen reverse driving means for reversely rotating said platen means and feeding back said print paper and said ribbon while said platen means is in contact with said thermal head means and said print paper and ribbon contact each other between said contacting platen means and thermal head means;

resistance removing means for removing resistance which is from said take-up spool means to said ribbon upon reverse rotation of said platen means, wherein said print paper and said ribbon are fed back by said platen reverse driving means at the same speed without relative slippage so as to prevent a staining of the print paper due to slippage relative to the ribbon; and ribbon core reverse driving means for reversely rotating said ribbon core means and rewinding said ribbon around said ribbon core means upon reverse rotation of said platen means, said ribbon core reverse driving means comprising a supply spool which can rotate independently of said ribbon core means and torsion spring means for connecting said supply spool with said ribbon core means and storing a reverse biasing force for said ribbon core means when said ribbon core means is forwardly rotated to twist said torsion spring means, such that when said platen means is reversely rotated, the reverse biasing force of said torsion spring means rewinds said ribbon around said ribbon core means.

2. The printer as defined in claim 1, wherein said resistance removing means comprises driving means for reversely rotating said take-up spool means in synchronism with the reverse rotation of said platen.

3. The printer as defined in claim 1, wherein said resistance removing means comprises driving means connected to said take-up spool means for driving said take-up spool means, and one-way clutch means provided between said take-up spool means and said driving means for cutting the drive connection between said take-up spool means and said driving means and permitting a free rotation of said take-up spool means when said driving means is reversely driven upon reverse rotation of said platen means.

4. The printer as defined in claim 1, wherein said resistance removing means comprises driving means connected to said take-up spool means for driving said take-up spool means, and clutch means provided between said take-up spool means and said driving means for cutting the drive connection between said take-up spool means and said driving means and permitting a free rotation of said take-up spool means when a reversing force is applied to said take-up spool means.

5. The printer as defined in claim 1, wherein said ribbon core reverse driving means is coaxial with said ribbon core means and comprises back tension means for giving friction to a free rotation of said supply spool.

6. The printer as defined in claim 5, further comprising independent rotation limiting means for limiting an angle of independent rotation of said ribbon core means relative to said supply spool to a predetermined angle.

* * * * *